US010000330B2

(12) United States Patent
Szekely et al.

(10) Patent No.: US 10,000,330 B2
(45) Date of Patent: Jun. 19, 2018

(54) MODULAR SPRAY CAP

(71) Applicant: Plastek Industries, Inc., Erie, PA (US)

(72) Inventors: Alex S. Szekely, Jackson, NJ (US); Timothy C. Dzurik, Erie, PA (US)

(73) Assignee: Plastek Industries, Inc., Erie, PA (US)

( * ) Notice: Subject to any disclaimer, the term of this patent is extended or adjusted under 35 U.S.C. 154(b) by 0 days. days.

(21) Appl. No.: 15/125,307

(22) PCT Filed: Mar. 6, 2015

(86) PCT No.: PCT/US2015/019187
§ 371 (c)(1),
(2) Date: Sep. 12, 2016

(87) PCT Pub. No.: WO2015/138241
PCT Pub. Date: Sep. 17, 2015

(65) Prior Publication Data

US 2017/0073149 A1 Mar. 16, 2017

Related U.S. Application Data

(60) Provisional application No. 61/950,243, filed on Mar. 10, 2014.

(51) Int. Cl.
*B05B 7/32* (2006.01)
*B65D 83/20* (2006.01)
(Continued)

(52) U.S. Cl.
CPC ..... *B65D 83/206* (2013.01); *B05B 1/3033* (2013.01); *B05B 1/3405* (2013.01);
(Continued)

(58) Field of Classification Search
CPC ... B05B 1/3033; B05B 1/3426; B05B 1/3421; B05B 1/3405; B65D 83/20; B65D 83/206; B65D 83/28; B65D 83/38
(Continued)

(56) References Cited

U.S. PATENT DOCUMENTS 3,154,615 A 10/1964 Cooprider
3,256,549 A 6/1966 Evesque
(Continued)

FOREIGN PATENT DOCUMENTS

WO 02/35121 A1 5/2002

OTHER PUBLICATIONS

International Search Report and Written Opinion for PCT/US2015/019187, dated Jun. 12, 2015.
(Continued)

*Primary Examiner* — Steven J Ganey
(74) *Attorney, Agent, or Firm* — Bachman & LaPointe, P.C.

(57) ABSTRACT

A spray cap (20; 300; 400; 600) for a spray can (22) has a body comprising: a sidewall (140) having a lower portion for mounting to a body of the spray can; and a button (36). The button has: an upper surface (164) for user engagement; a downwardly projecting sleeve (38) for receiving an outlet stem (240) of the can; and a forwardly-open compartment (42). An insert (34; 302) is within the compartment. A nozzle member (32) is mounted across the compartment to contain the insert within the compartment.

19 Claims, 11 Drawing Sheets

(51) Int. Cl.

| | |
|---|---|
| ***B05B 1/34*** | (2006.01) |
| ***B05B 1/30*** | (2006.01) |
| ***B65D 83/28*** | (2006.01) |
| *B65D 83/38* | (2006.01) |

(52) U.S. Cl.
CPC ..... *B05B 1/3421* (2013.01); *B05B 1/3426* (2013.01); *B65D 83/20* (2013.01); *B65D 83/28* (2013.01); *B65D 83/38* (2013.01)

(58) Field of Classification Search
USPC ..... 239/333, 337, 468–471, 476, 482, 483, 239/487, 488, 1; 222/153.11, 402.11, 222/402.12, 402.13
See application file for complete search history.

(56) References Cited

U.S. PATENT DOCUMENTS

| | | | | |
|---|---|---|---|---|
| 3,306,252 | A | 2/1967 | Knight et al. | |
| 3,570,770 | A * | 3/1971 | Ewald | B05B 1/3421 239/337 |
| 3,744,678 | A | 7/1973 | Beres et al. | |
| 3,792,802 | A | 2/1974 | Gores | |
| 3,841,532 | A | 10/1974 | Gores | |
| 3,865,283 | A | 2/1975 | Hayes | |
| 3,887,115 | A | 6/1975 | Petterson | |
| 3,917,127 | A | 11/1975 | Berenstain | |
| 3,936,000 | A | 2/1976 | Weyn | |
| 4,154,375 | A | 5/1979 | Bippus | |
| 4,187,985 | A * | 2/1980 | Goth | B05B 7/063 239/337 |
| 4,420,099 | A | 12/1983 | Pizzurro et al. | |
| 4,986,453 | A | 1/1991 | Lina et al. | |
| 5,567,073 | A | 10/1996 | de Laforcade et al. | |
| 5,624,055 | A | 4/1997 | Clanet et al. | |
| 6,113,008 | A | 9/2000 | Arsenault et al. | |
| 6,123,234 | A | 9/2000 | Lai | |
| 6,158,674 | A | 12/2000 | Humphreys | |
| 6,161,736 | A | 12/2000 | Kaufman et al. | |
| 6,354,519 | B1 | 3/2002 | Kidooka et al. | |
| 6,412,671 | B1 | 7/2002 | Riley et al. | |
| 7,044,337 | B1 | 5/2006 | Kou | |
| 7,080,759 | B2 | 7/2006 | Petit | |
| 7,300,001 | B2 * | 11/2007 | Kuo | A61M 11/00 239/488 |
| 7,500,583 | B1 | 3/2009 | Cox | |
| 7,530,476 | B2 | 5/2009 | Downey et al. | |
| 7,784,645 | B2 | 8/2010 | Carta | |
| 7,784,647 | B2 | 8/2010 | Tourigny | |
| 7,938,342 | B2 * | 5/2011 | Octeau | B05B 1/3436 239/337 |
| 8,127,968 | B2 | 3/2012 | Yerby et al. | |
| 8,528,838 | B2 * | 9/2013 | Imenez | B05B 1/26 239/487 |
| 2007/0041774 | A1 | 2/2007 | Tourigny | |
| 2009/0230156 | A1 | 9/2009 | Prox et al. | |
| 2012/0217322 | A1 | 8/2012 | Songbe | |
| 2013/0008982 | A1 * | 1/2013 | Shah | A61L 9/14 239/494 |

OTHER PUBLICATIONS

U.S. Office Action for U.S. Appl. No. 13/308,960, dated Nov. 26, 2014.
U.S. Office Action for U.S. Appl. No. 13/308,960, dated Jun. 17, 2015.
U.S. Office Action for U.S. Appl. No. 13/308,960, dated Jan. 13, 2016.

* cited by examiner

MODULAR SPRAY CAP

CROSS-REFERENCE TO RELATED APPLICATION

Benefit is claimed of U.S. Patent Application No. 61/950,243, filed Mar. 10, 2014, and entitled "Modular Spray Cap", the disclosure of which is incorporated by reference herein in its entirety as if set forth at length.

BACKGROUND OF THE INVENTION

The invention relates to pressurized spray containers. More particularly, the invention relates to spray dispensing of personal care compositions (e.g., deodorants, antiperspirant, and the like) and household chemicals (e.g., cleaners, air fresheners, and the like).

A typical spray container or bottle takes the form of a metallic can having a top-mounted valve assembly. Exemplary valve assemblies are actuated by depressing a spray nozzle mounted at the top of the valve assembly to open the valve and create a pathway for contents of the can to exit under pressure. In some containers, the contents are contained within a bag and the pressurant is within the can surrounding the bag. In some containers, the valve inlet is formed as or connected to a dip tube which extends down into a body of liquid in the can. In bag-less variations, the headspace of the can above the liquid contains the pressurant in normal use. Common valve assemblies include male type and female type. In a male valve assembly, a stem extends upward from the valve and is received in the nozzle. Depression of the nozzle acts to depress the stem to open the valve. In female valve assemblies, the nozzle includes a stem which is received in the valve assembly and similarly actuates spraying.

In a traditional spray nozzle, the user depresses a top of the nozzle with the user's index finger and sprays discharge from a lateral outlet in the nozzle. More recently, ergonomic caps have been developed that provide for a broader area for actuation and may facilitate a more ergonomic use, for example, of the thumb instead of the index finger. U.S. Pat. No. 6,161,736 issued Dec. 19, 2000 and entitled "Dispenser Apparatus" discloses a system wherein a modified conventional pushbutton nozzle is received within an overcap which has a broad finger-actuatable portion hinged relative to a main body mounted to the can. Another variation on such a system is shown in U.S. Pat. No. 7,530,476 issued May 12, 2009 and entitled "Locking Aerosol Dispenser" which contains a more complex arrangement of pieces.

SUMMARY OF THE INVENTION

One aspect of the disclosure involves a spray cap for a spray can. The spray cap has a body comprising: a sidewall having a lower portion for mounting to a body of the spray can; and a button. The button has: an upper surface for user engagement; a downwardly projecting sleeve for receiving an outlet stem of the can; and a forwardly-open compartment. An insert is within the compartment. A nozzle member is mounted across the compartment to contain the insert within the compartment.

A further embodiment may additionally and/or alternatively include the spray cap in combination with the can, the can including a valve having the outlet stem. The sidewall lower portion is mounted to the body of the spray can and the sleeve receives an upper portion of the outlet stem.

A further embodiment may additionally and/or alternatively include the valve having an open condition and a closed condition; the button is depressable from a first position to a second position; a lower rim of the sleeve being spaced apart from a shoulder of the valve in the first position; the lower rim contacting the shoulder in the second position; and depressing of the button from the first position to the second position bringing the lower rim into contact with the shoulder to depress the shoulder and shift the valve from the closed condition to the open condition.

A further embodiment may additionally and/or alternatively include the can being a metallic can containing a body of the product to be dispensed.

A further embodiment may additionally and/or alternatively include a method for using the combination. The method comprises depressing the button from a first position to a second position. A lower rim of the sleeve is spaced apart from a shoulder of the valve in the first position. The lower rim contacts the shoulder in the second position. The depressing of the button from the first position to the second position brings the rim into contact with the shoulder to depress the shoulder and shift the valve from the closed condition to the open condition to discharge a spray of the product from the nozzle.

A further embodiment may additionally and/or alternatively include the product flowing upward to the sleeve and passing forwardly along perimeter channels in the insert to a chamber between a forward end of the insert and the nozzle.

A further embodiment may additionally and/or alternatively include the body further comprising a living hinge between the button and the sidewall.

A further embodiment may additionally and/or alternatively include the body being unitarily molded as a single piece.

A further embodiment may additionally and/or alternatively include the body consisting of a single piece plastic molding, the nozzle consisting of a single piece plastic molding, and the insert consisting of a single piece plastic molding.

A further embodiment may additionally and/or alternatively include the body compartment comprising a forwardly-projecting pin, and the insert having a compartment receiving the pin.

A further embodiment may additionally and/or alternatively include the body compartment comprising a blind rear end and the insert having an end received in the blind rear end.

A further embodiment may additionally and/or alternatively include the insert comprising a plurality of longitudinal grooves. The nozzle member has: a transverse web having a nozzle aperture; and a collar extending aft from the transverse web and received in the compartment. The insert has an end received by an inner diameter surface of the collar and abutting an aft surface of the web.

A further embodiment may additionally and/or alternatively include the insert having a central recess in the end.

A further embodiment may additionally and/or alternatively include a method for using the spray cap, the method comprising: depressing the button to discharge a spray of the product from the nozzle.

A further embodiment may additionally and/or alternatively include flow of the product passing through channels along the insert.

A further embodiment may additionally and/or alternatively include a method for assembling the spray cap. The method comprising inserting the insert into the compartment and assembling the nozzle member to the body to capture the insert.

A further embodiment may additionally and/or alternatively include a plurality of identical bodies used with a plurality of differing inserts and/or differing nozzle members.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
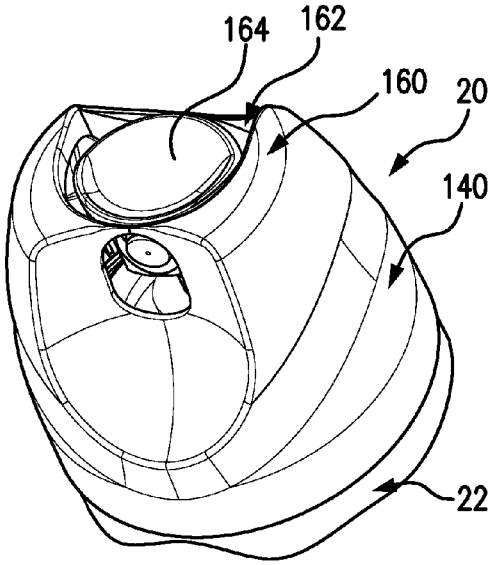
FIG. 1 is a view of a spray cap and can combination with can partially cutaway.
Figure 5:
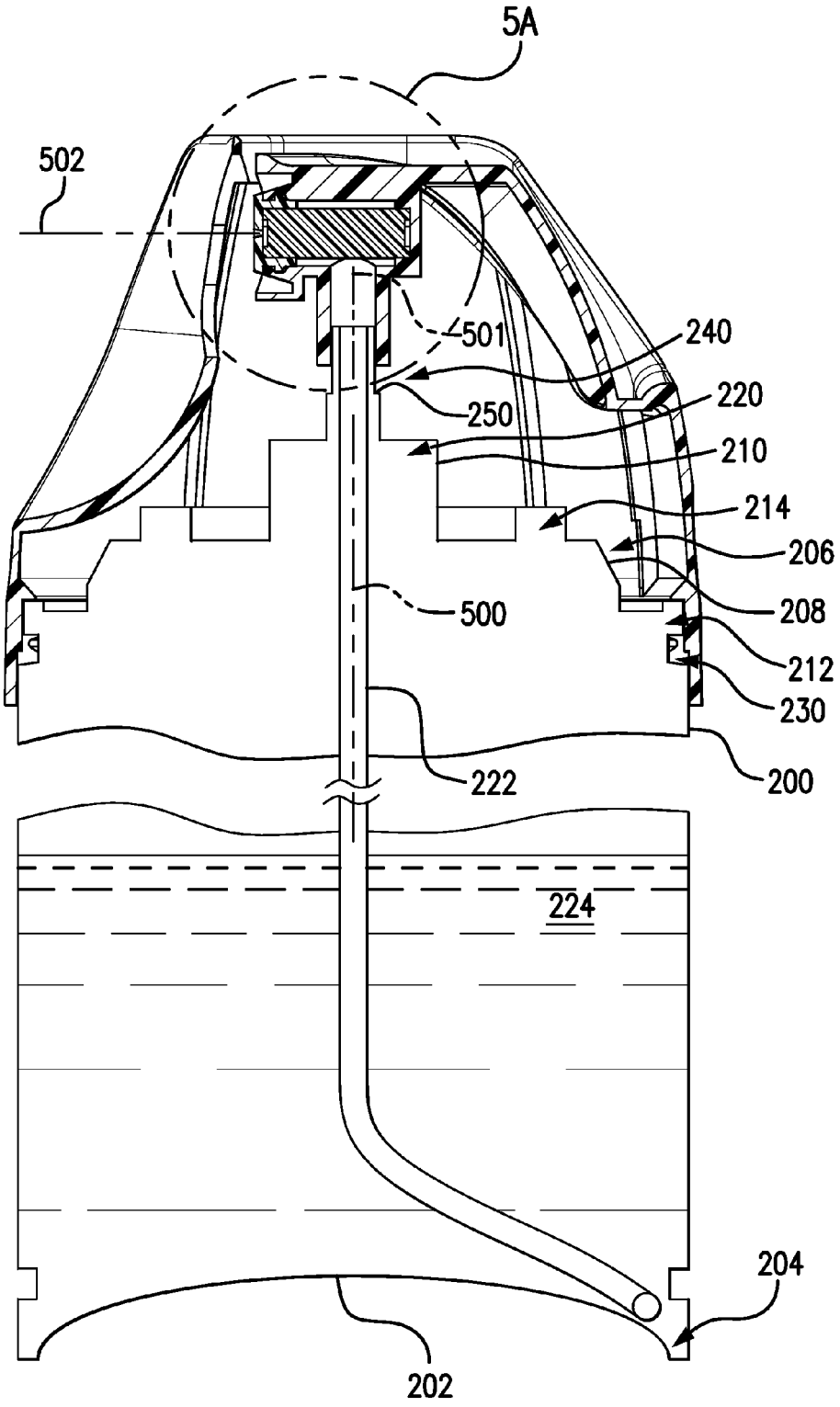
FIG. 5 is a central vertical longitudinal sectional view of the combination with can schematically shown in profile.

FIG. 1 shows a cap (cap assembly) 20 on a container (cutaway) 22. The exemplary container comprises a metallic can having a central vertical axis 500 (FIG. 5). The exemplary can comprises any of a number of prior art or yet-developed can configurations. However, other configurations may be used. The exemplary can configuration (FIG. 5) comprises a metallic sidewall 200 of nominal right circular cylindrical configuration (e.g., formed of sheet steel and soldered (or otherwise closed) along a longitudinal seam (not shown)). The exemplary can further comprises a single-piece bottom/base 202 formed of a metal (e.g., stainless steel) stamping and crimped (at an annular joint or crimp 204) to a lower rim portion of the sidewall. The exemplary bottle further comprises a top 206. The exemplary top is formed of a multi-piece assembly comprising an outer member 208 and an inner member 210 (formed as a valve cup—discussed below). Both exemplary outer and inner members are metal (e.g., stainless steel) stampings with the outer member secured at its outer periphery to an upper rim portion of the sidewall 200 at an annular joint or crimp 212. At its inner periphery (inner diameter or ID) the outer member 208 is secured to an outer peripheral (outer diameter or OD) portion of the valve cup 210 at an annular joint or crimp 214. The various crimps may, themselves, be soldered or otherwise sealed/secured in addition to the mechanical interlocking provided by the crimping action.

A valve assembly 220 may be mounted to the top 206 (e.g., to the valve cup 210) within the can. In various implementations, a dip tube 222 may extend into the can from the valve assembly. A lower end of the dip tube extends within a body 224 of the liquid product to be dispensed when the container is upright. An upper end portion of the dip tube may mate directly or indirectly with the valve structure. The dip tube may be within a bag or replaced by a bag (not shown) containing the body 224 of liquid contents (e.g., a personal care product such as deodorant and/or antiperspirant or a household maintenance product such as air freshener), surface cleaner or the like) to be dispensed. Other configurations may eliminate the dip tube.

The exemplary valve is shown as a conventional spring-biased male valve having an upwardly projecting outlet stem 240 having a central passageway 242 (FIG. 5A) coaxial with the can axis 500 and extending to an upper rim 244. FIG. 5 shows a closed/extended condition of the valve stem. The valve stem 240 is depressible against spring (not shown) bias into a depressed/opened condition (discussed below) to establish communication from the body of container contents through the nozzle.

Figure 5A:
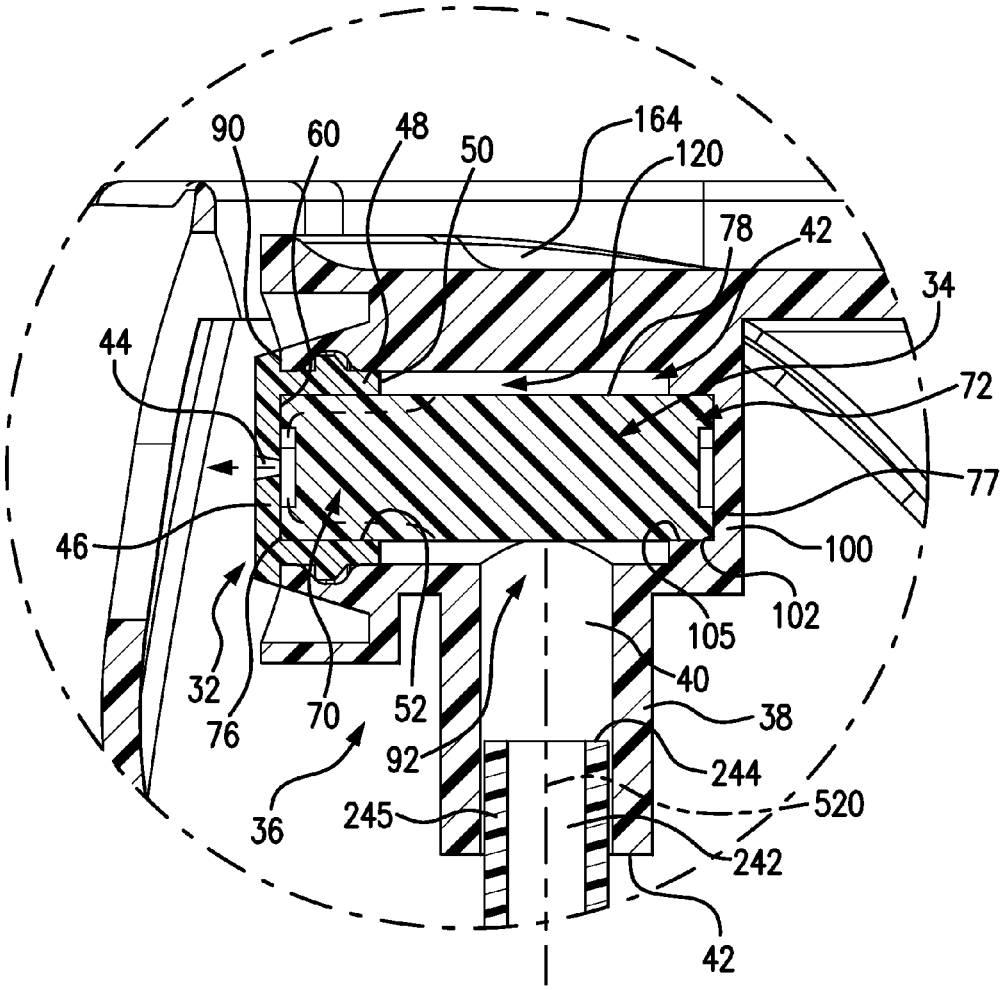
FIG. 5A is an enlarged view of a nozzle region of the combination of FIG. 5.
Figure 6:
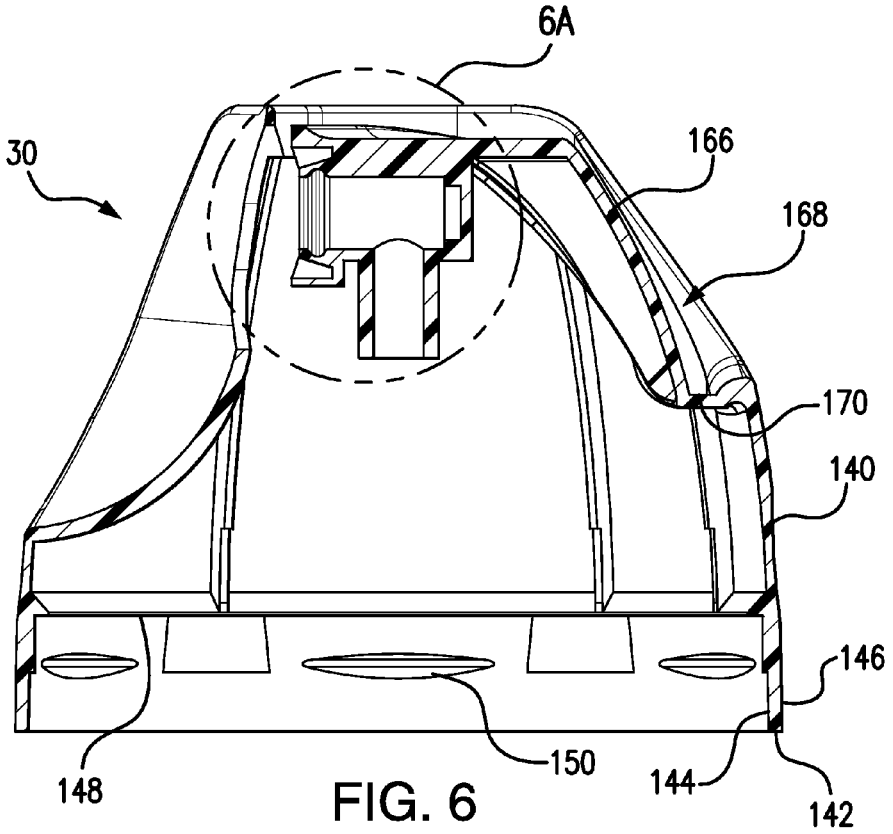
FIG. 6 is a central vertical longitudinal sectional view of a main body of the cap.
Figure 6A:
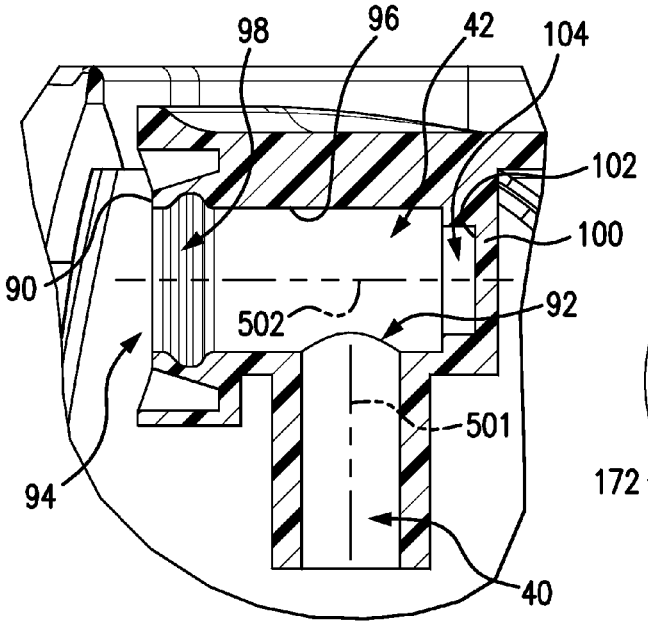
FIG. 6A is an enlarged view of a portion of the body of FIG. 6.
Figure 8:
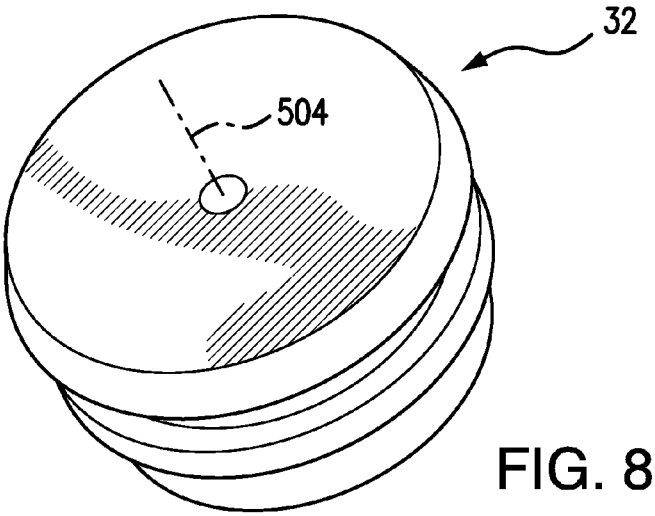
FIG. 8 is a view of a nozzle or outlet element of the cap.
Figure 9:
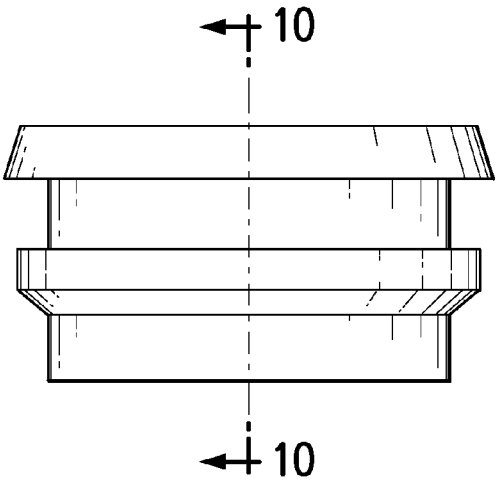
FIG. 9 is a side view of the outlet element.
Figure 11:
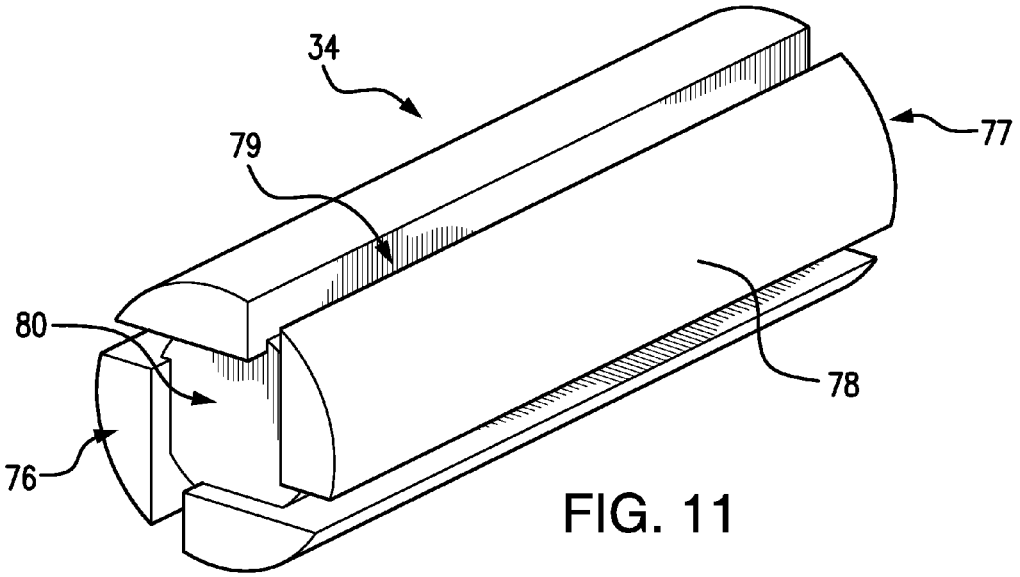
FIG. 11 is a view of a flow metering insert for the cap.
Figure 13:
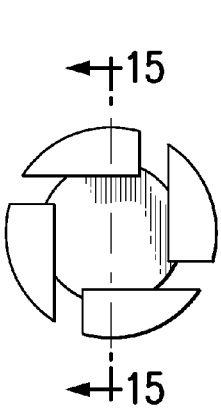
FIG. 13 is a first end view of the insert.
Figure 12:
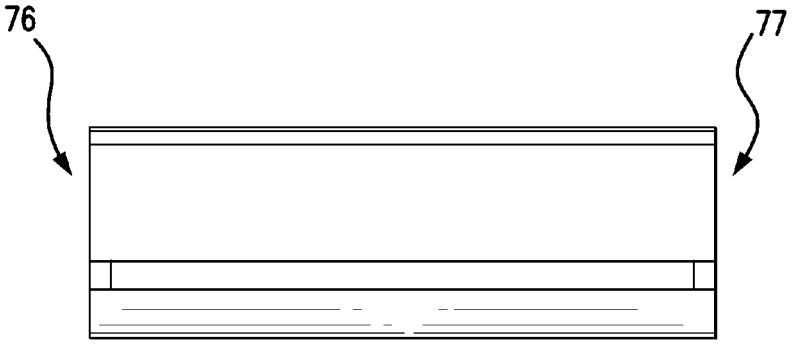
FIG. 12 is a side view of the insert.
Figure 14:
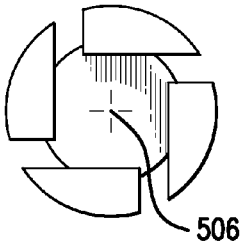
FIG. 14 is a second end view of the insert.
Figure 15:
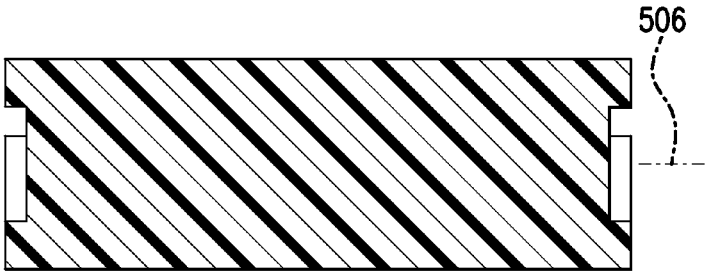
FIG. 15 is a central longitudinal sectional view of the insert taken along the line 15-15 of FIG. 13.

As is discussed further below, the exemplary cap assembly 20 comprises a combination of a main body 30 (FIG. 6), a nozzle or outlet member 32 (FIG. 8), and an insert 34 (FIG. 11). FIG. 6A shows a region or section 36 (receptacle) of the cap main body that receives the outlet member and insert. FIG. 5A shows the outlet member 32 and insert 34 installed in associated section 36 of the cap main body. As is discussed below, the section 36 serves as a button.

The section 36 comprises a downwardly-extending collar or sleeve 38 having a central passageway 40 sharing the vertical axis 500 in the initial condition and extending downward to a lower rim 42. A lower portion of the collar 38 receives an upper portion 245 of the outlet stem 240. As is discussed further below, a depressing of the section 36 lowers the collar 38 to progressively receive more of the stem 240. Eventually, the rim 42 contacts a shoulder 250 (FIG. 5) of the outlet stem whereafter further depressing of the section 36 depresses the outlet stem to actuate the valve to open the valve. Closing the valve is via opposite movement driven by the valve spring.

With the valve open, flow up through the passageway 242 (FIG. 5A) enters the passageway 40 (having an axis 501) which intersects a compartment 42. The compartment 42 has an axis 502 (e.g., intersecting the axis 500 at a right angle) receives the insert 34. The flow passes around/through the insert (discussed below) and then out the nozzle opening or outlet (hereafter simply nozzle) 44. Exemplary nozzle 44 is a central longitudinal aperture in a transverse web 46 of the outlet member 32. The exemplary outlet member 32 includes an annular collar-like sidewall 48 extending to a rim 50.

Figure 10:
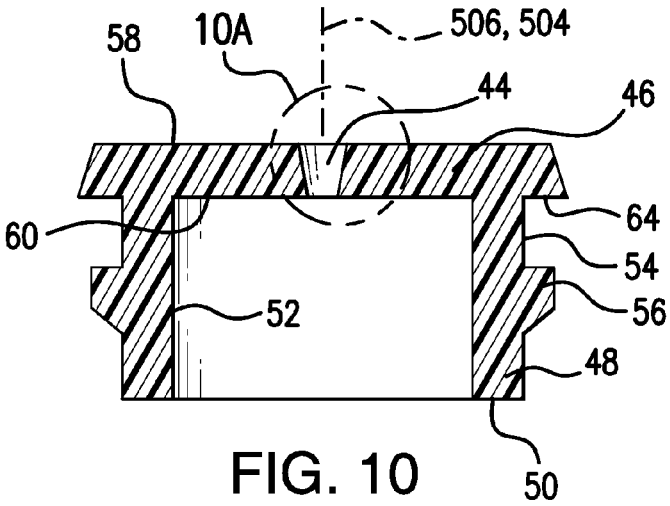
FIG. 10 is a central longitudinal sectional view of the outlet element taken along line 10-10 of FIG. 9
Figure 10A:
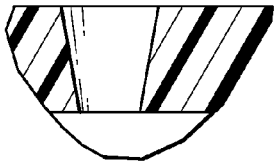
FIG. 10A is an enlarged view of a nozzle opening region of the outlet element of FIG. 10.

Turning to FIG. 10, the collar 48 has an axis 504 (coincident with 502 when installed), an inboard or inner diameter (ID) surface 52, and an outboard or outer diameter (OD) surface 54. An annular barb 56 extends from the surface 54 for locking the outlet member 32 in place (discuss below). The web 46 has a longitudinally outboard or outer surface 58 and an inboard surface 60. A central portion of the inboard surface 60 cooperates with the ID surface 52 to receive an adjacent end portion 70 (FIG. 5A) of the insert 34. A radially outboard portion of the surface 60 acts as a stop, engaging an abutting rim surface (rim) 90 of the section 36. FIG. 6A shows the compartment 42 having a junction 92 with the channel 40 and extending to an opening 94 surrounded by the rim 90. A lateral surface 96 of the compartment includes a forward radially-outwardly extending channel or groove 98 near the opening 94 to receive and capture the aforementioned barb 56.

The exemplary compartment 42 comprises an aft wall 100 having an inner surface 102. An aft or base portion 104 of the compartment is of reduced transverse dimension (diameter) relative to a remaining portion to receive and register an associated aft portion 72 (FIG. 5A) of the insert 34.

FIG. 11 shows further details of an exemplary insert 34. The exemplary insert is formed as a modified circular cylinder (having lateral longitudinal axis 506 coincident with 502 when installed) extending between a first end 76 and a second end 77 and having a segmented circular cylindrical outer surface 78 circumferentially segmented by longitudinal grooves or channels 79. Each of the ends 76 and 77 has a shallow central recess 80. Recess 80 is open to the adjacent ends of channels 79 to help pass fluid, as is discussed below. Thus, except for the exemplary ends of the exemplary channels 79 and the recesses 80 the exemplary ends 76, 77 have flat circular surfaces.

In the installed condition of FIG. 5A, one of the insert ends (e.g., 77) abuts the surface 102 of wall 100 and the cylindrical surface portions of the adjacent portion 72 contact the inner surface 105 of the compartment base portion 104. Forward, along the main portion of the compartment, the surface 78 is spaced apart from the interior lateral surface of the compartment to create a gap 120. The flat surface of the other end 76 abuts the underside 60 of the flange 46 and the section 70 is similarly received by the ID surface 52. A flowpath 520 for contents of the container thus extends up through the outlet tube into the passageway 40 to the junction 92 and passes forward through the gap 120 and the channels 79. With the rim 50 of the outlet member blocking the gap 120, the flow then proceeds through terminal portions of channels 79 into the recess 80 of the end 76 and then out the nozzle 44.

Exemplary cap body, outlet member, and insert materials are molded plastic (e.g., polypropylene).

The use of the outlet member 32 and insert 34 may have a number of advantages over alternative configurations. If the nozzle were to be molded as part of the cap main body, this would impose molding complications. For example, it would be difficult to precisely mold a very narrow front-to-back passageway intersecting a vertical passageway such as 40. This would involve fine tooling and has increased risk of flash blocking the junction. Long narrow passageways are also potentially more subject to plugging from contents being dispensed. Passageway 40 and compartment 42 may thus be molded much more easily.

Other advantages attend engineering and manufacturing. For example, a given cap main body configuration may be used with variations on the outlet member 32 or insert 34 to accommodate different liquids being dispensed. Because the cap main body is the most complicated part, economies of scale in its manufacture may outweigh any additional costs of the other components. Additionally, engineering of new configurations may be eased because one can easily manufacture different prototype versions of the outlet member 32 and/or insert 34 (e.g., by 3-d printing or machining) to test different options. One might very quickly be able to manufacture hundreds of different alternative outlet member and insert combinations for testing whereas similar effort would yield only a few options of a one-piece system.

Other details of the cap main body may be similar to a number of known or yet-developed configurations of such caps that have large hinged buttons. Turning to FIG. 6, the exemplary cap main body comprises a sidewall 140 extending upward from a lower rim 142. The sidewall has respective generally inner and outer surfaces 144 and 146. A lower portion of the sidewall may be configured to mate with the can. The exemplary configuration has an internal inwardly-directed shoulder 148 positioned to abut a rim of the crimp 212 of FIG. 5. Between the shoulder 148 and the rim 142 the inner surface 144 may have plurality of inwardly-directed projections 150 for capture by an annular channel 230 between the crimp 212 and a main portion of the sidewall 200 to retain the cap against extraction.

Figure 2:
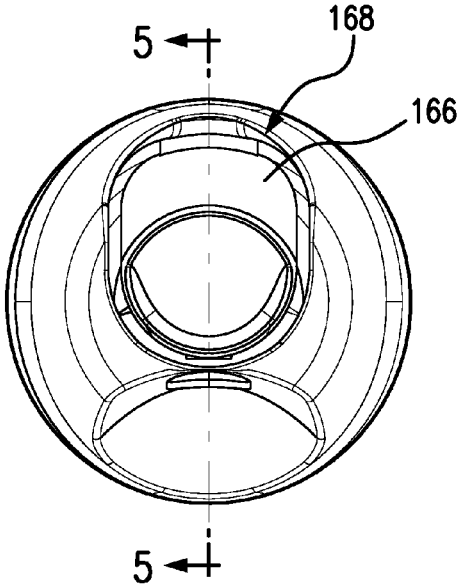
FIG. 2 is a top view of the combination.
Figure 3:
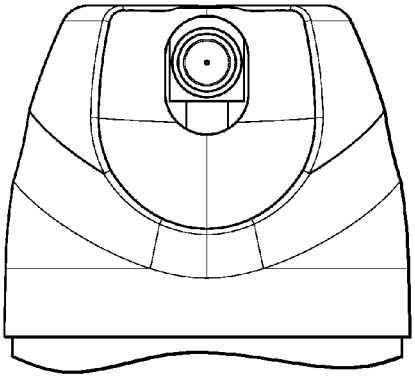
FIG. 3 is a front view of the combination.
Figure 4:
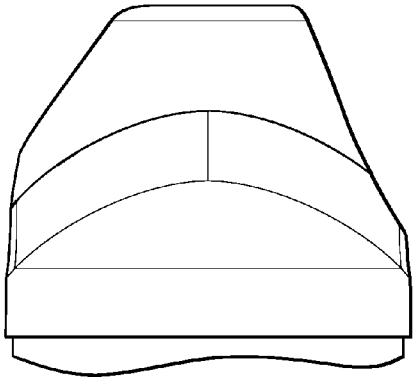
FIG. 4. is a side view of the combination.

The sidewall 140 extends upward to a segmented upper rim 160 (FIG. 1) having a gap 162 through which a button surface 164 is exposed. The button surface 164 is formed along a top of the section 36 of FIG. 5A. Section 166 (FIG. 2) extends downward within a sidewall opening 168 formed as a continuation of the upper opening 162 (FIG. 6). At its base, the section 166 is joined by a flexible living hinge 170 to the adjacent portion of the sidewall 140. Insert depression of the surface 164 causes flexing of the hinge and a downward shifting of the section 36. The exemplary hinge does not have a single axis but may slightly rack so that the effect is to allow the section 36 to move closer to a straight downward motion than a pure rotation.

Figure 7:
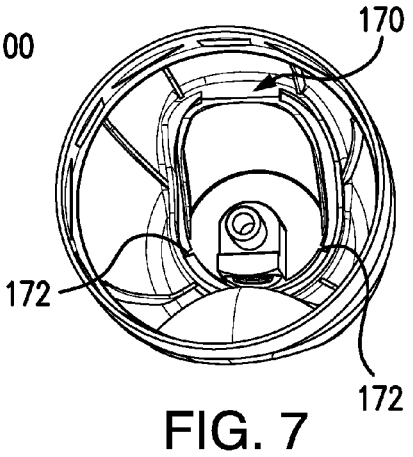
FIG. 7 is a view of an underside of the cap body.

Additionally, as is known in the art, the cap may initially be molded with frangible connections 172 (FIG. 7) to initially retain the cap in the open condition prior to the first dispensing.

Figure 16A:
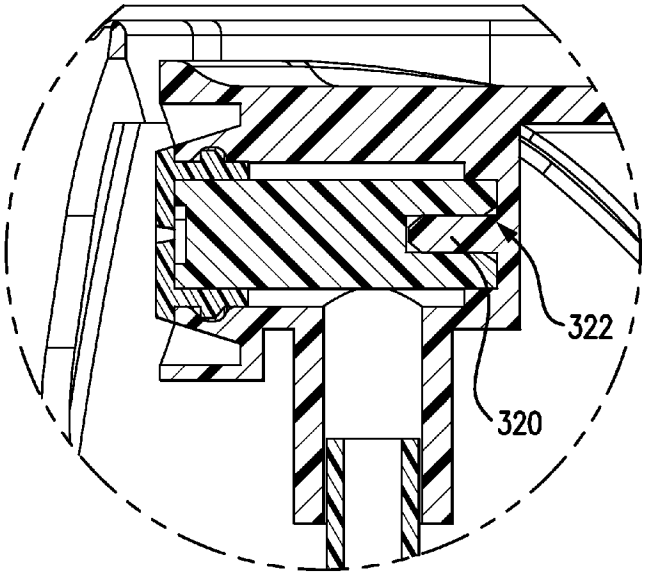
FIG. 16A is an enlarged view of a nozzle region of the second cap.
Figure 16:
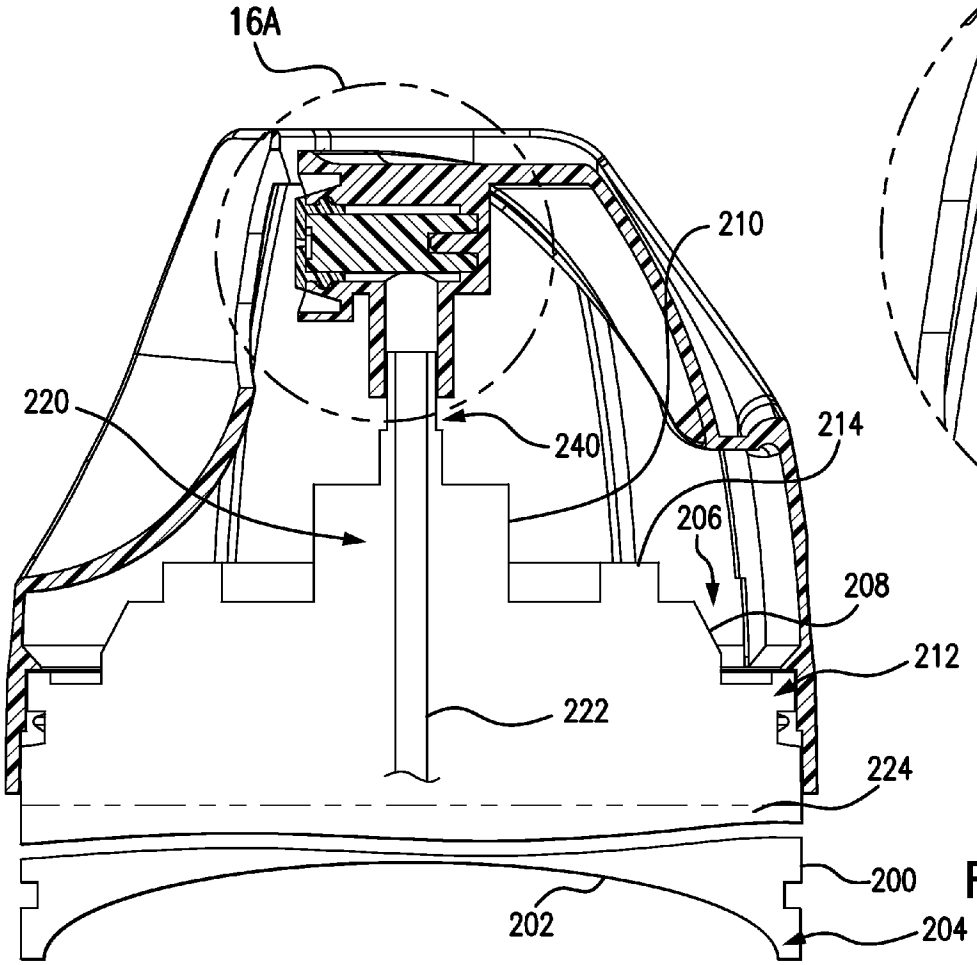
FIG. 16 is a central vertical longitudinal sectional view of a combination of a second cap with the can.
Figure 17:
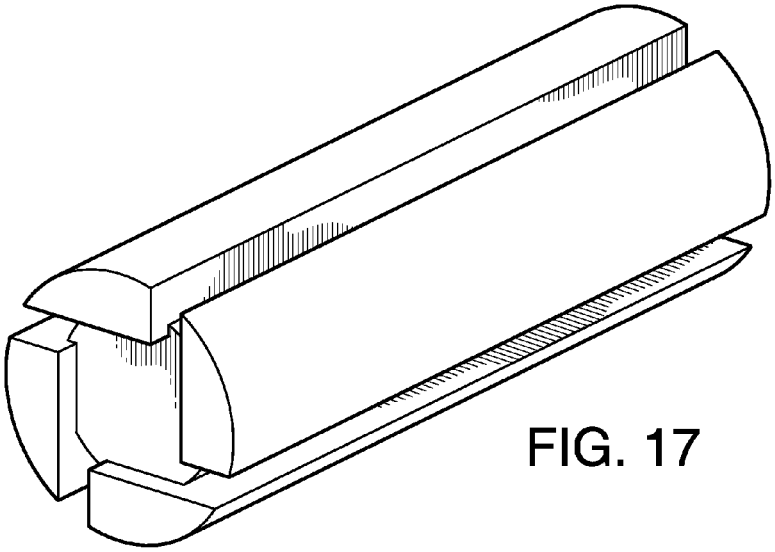
FIG. 17 is a view of a second insert for use with the second cap.
Figure 19:
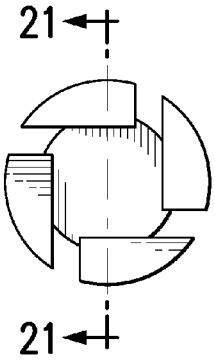
FIG. 19 is a first end view of the second insert.
Figure 20:
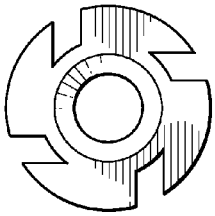
FIG. 20 is a second end view of the second insert.
Figure 18:
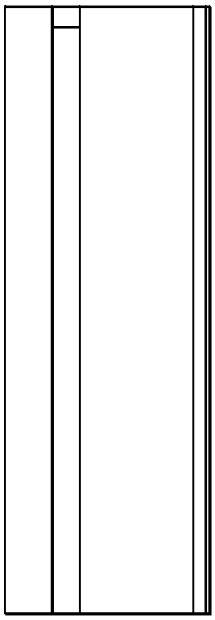
FIG. 18 is a side view of the second insert.
Figure 21:
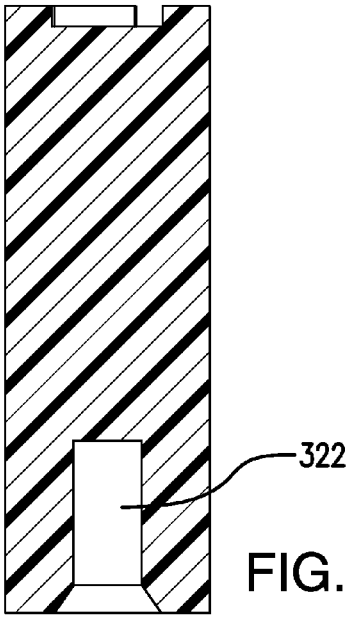
FIG. 21 is a longitudinal sectional view of the second insert taken along line 21-21 of FIG. 19.
Figure 22:
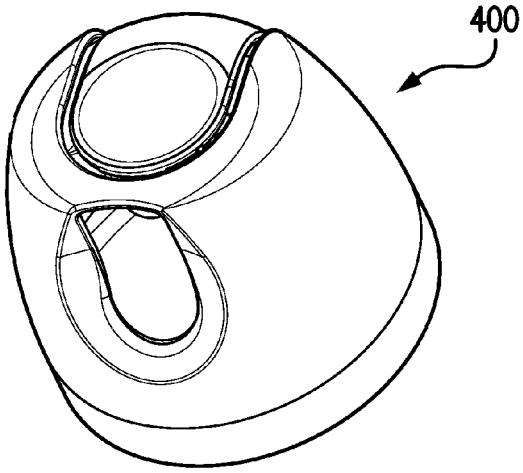
FIG. 22 is a view of a third spray cap.
Figure 23:
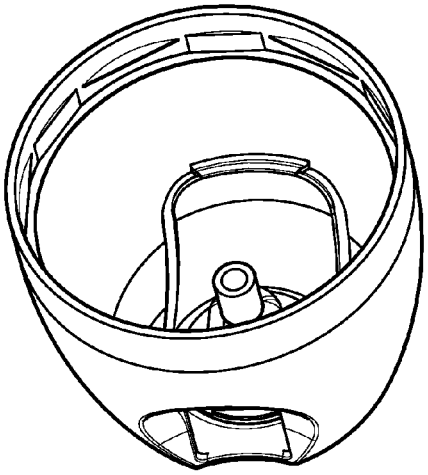
FIG. 23 is an interior view of the third spray cap.
Figure 24:
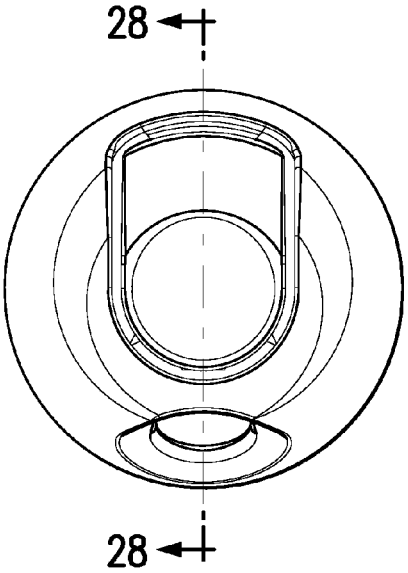
FIG. 24 is a top view of the third spray cap.
Figure 25:
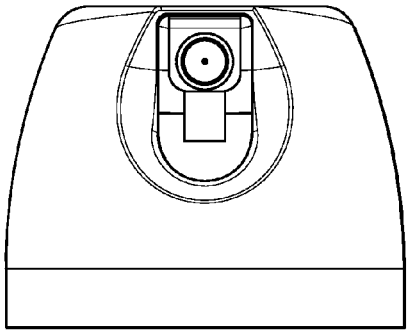
FIG. 25 is a front view of the third spray cap.
Figure 26:
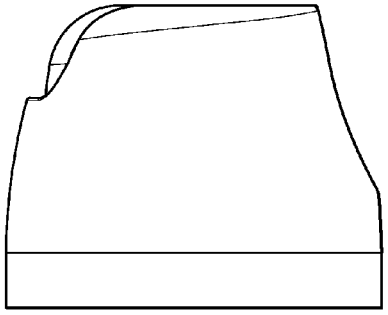
FIG. 26 is a side view of the third spray cap.
Figure 27:
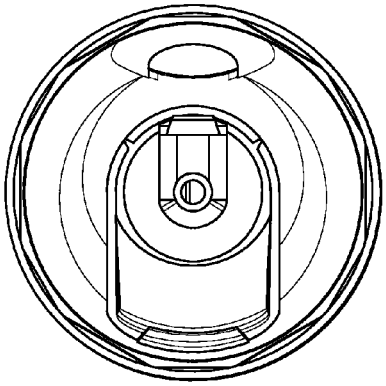
FIG. 27 is a bottom view of the third spray cap.
Figure 28:
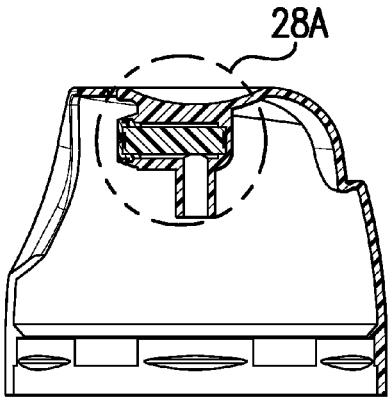
FIG. 28 is a central vertical longitudinal sectional view of the third spray cap taken along line 28-28 of FIG. 24.
Figure 28A:
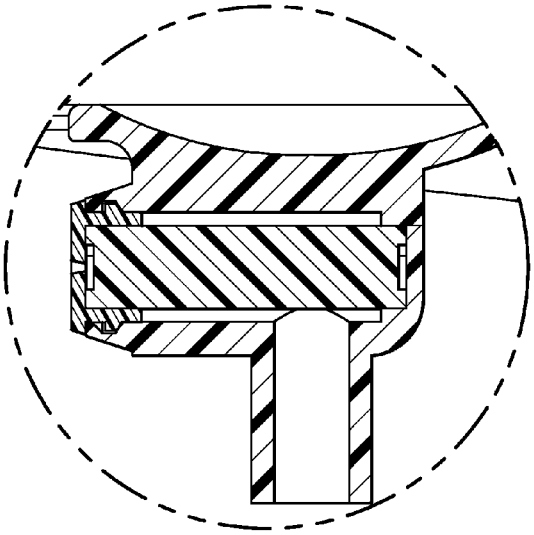
FIG. 28A is an enlarged view of a nozzle region of the third spray cap of FIG. 28.

FIG. 16 shows an alternate cap assembly 300 which may use an alternate insert 302 but a similar outlet member to that described above. Rather than having the insert end simply abut a flat aft end of the compartment, the exemplary compartment has a forwardly-extending pin 320 (FIG. 8) which is received in a longitudinal compartment 322 in the insert. FIGS. 17-21 show further details of the exemplary insert. Laterally and at the forward end, the insert is otherwise similar to the insert described above. However, the aft end of the insert bears the compartment 322 for receiving the pin. Thus, the exemplary second insert may be positioned by the pin in addition to or alternative to being positioned by the lateral surface of the compartment. Thus, although the exemplary insert 34 is bidirectional, (i.e., either of the two ends could be inserted into the compartment), the second insert might be unidirectional.

FIGS. 22-28A show a spray cap 400 that may be generally similar to the cap 20. Generally similar inserts and nozzles are used. The exemplary insert is shown slightly more elongate than the insert of the cap 20 but otherwise the same. Material, manufacture, and use details may also be similar. A shallower well along the front of the cap is associated with a slightly larger opening to allow passage of the spray through the cap sidewall in view of the greater standoff distance between the sidewall and the nozzle. Yet further variations are possible.

Figure 29:
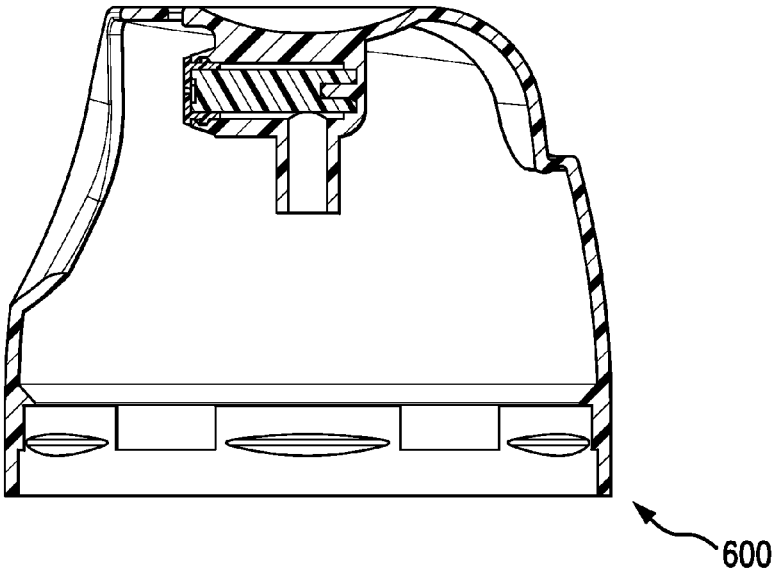
FIG. 29 is a central vertical longitudinal sectional view of a fourth spray cap.

FIG. 29 shows a spray cap 600 which has the same differences relative to the cap 400 that the cap 300 has relative to the cap 20.

One or more embodiments of the present invention have been described. Nevertheless, it will be understood that various modifications may be made without departing from the spirit and scope of the invention. For example, ergonomic modifications and modifications for use with particular bottles (cans) (e.g., other valves, including female valves and other can geometries) may be made. Accordingly, other embodiments are within the scope of the following claims.

What is claimed is:

1. A spray cap (20; 300; 400; 600) for a spray can (22), the spray cap comprising:
- a body comprising:
  - a sidewall (140) having a lower portion for mounting to a body of the spray can;
  - a button (36) having:
    - an upper surface (164) for user engagement;
    - a downwardly projecting sleeve (38) for receiving an outlet stem (240) of the can; and
  - a forwardly-open compartment (42) having a blind rear end; and
- an insert (34; 302) within the compartment and having an end received in the blind rear end; and
- a nozzle member (32) mounted across the compartment to contain the insert within the compartment.

2. A combination of the spray cap and the spray can of claim 1, the can including a valve having the outlet stem wherein:
- the sidewall lower portion is mounted to the body of the spray can; and
- the sleeve receives an upper portion (245) of the outlet stem.

3. The combination of claim 2 wherein:
- the valve has an open condition and a closed condition;
- the button is depressable from a first position to a second position;
- a lower rim (42) of the sleeve is spaced apart from a shoulder (250) of the valve in the first position;
- the lower rim contacts the shoulder in the second position; and
- depressing of the button from the first position to the second position brings the lower rim (42) into contact with the shoulder (250) to depress the shoulder and shift the valve from the closed condition to the open condition.

4. The combination of claim 2 wherein:
- the can is a metallic can containing a body (224) of the product to be dispensed.

5. A method for using the combination of claim 2 comprising:
- depressing the button from a first position to a second position, wherein:
- a lower rim of the sleeve is spaced apart from a shoulder of the valve in the first position;
- the lower rim contacts the shoulder in the second position; and
- the depressing of the button from the first position to the second position brings the rim into contact with the shoulder to depress the shoulder and shift the valve from the closed condition to the open condition to discharge a spray of the product from the nozzle.

6. The method of claim 5 wherein:
- the product flows upward to the sleeve and passes forwardly along perimeter channels (79) in the insert to a chamber between a forward end of the insert and the nozzle.

7. The spray cap of claim 1 wherein the body further comprises:
- a living hinge between the button and the sidewall.

8. The spray cap of claim 1 wherein:
- the body is unitarily molded as a single piece.

9. The spray cap of claim 1 wherein:
- the body consists of a single piece plastic molding;
- the nozzle consists of a single piece plastic molding; and
- the insert consists of a single piece plastic molding.

10. The spray cap of claim 1 wherein:
- the body compartment comprises a forwardly-projecting pin (320); and
- the insert has a compartment (322) receiving the pin.

11. The spray cap of claim 1 wherein:
- the body compartment blind rear end has an inner surface; and
- the insert end has a lateral surface received in and contacting the blind rear end inner surface.

12. The spray cap of claim 1 wherein:
- the insert (34) comprises a plurality of longitudinal grooves (79);
- the nozzle member (32) has:
  - a transverse web (46) having a nozzle aperture (44); and
  - a collar (48) extending aft from the transverse web and received in the compartment (42); and
- the insert has an end (70) received by an inner diameter surface (52) of the collar and abutting an aft surface (60) of the web.

13. The spray cap of claim 1 wherein:
- the insert has a central recess (80) in the end.

14. A method for using the spray cap of claim 1, the method comprising:
- depressing the button to discharge a spray of the product from the nozzle.

15. The method of claim 14 wherein:
- flow of the product passes through channels along the insert.

16. A method for assembling the spray cap of claim 1, the method comprising:
- inserting the insert into the compartment; and
- assembling the nozzle member to the body to capture the insert.

17. The method of claim 16 wherein:
- a plurality of identical bodies are used with a plurality of differing inserts and/or differing nozzle members.

18. The spray cap of claim 1 wherein:
- the body is unitarily molded as a single piece.

19. A spray cap for a spray can, the spray cap comprising:

a body comprising:

a sidewall having a lower portion for mounting to a body of the spray can;

a button having:

an upper surface for user engagement;

a downwardly projecting sleeve for receiving an outlet stem of the can; and a forwardly-open compartment having a forwardly-projecting pin; and an insert within the body compartment and having a compartment receiving the pin; and a nozzle member mounted across the body compartment to contain the insert within the body compartment.

* * * * *